US007043942B2

(12) United States Patent
Chapman

(10) Patent No.: US 7,043,942 B2
(45) Date of Patent: May 16, 2006

(54) CIRCULAR KNIT BLANK AND A GARMENT MADE THEREFROM

(75) Inventor: Joseph W Chapman, Tobaccoville, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 477 days.

(21) Appl. No.: 10/610,324

(22) Filed: Jun. 30, 2003

(65) Prior Publication Data

US 2004/0261467 A1 Dec. 30, 2004

(51) Int. Cl.
*D04B 1/22* (2006.01)

(52) U.S. Cl. ..... 66/177

(58) Field of Classification Search ..... 66/169 R, 66/170, 171, 172 E, 175, 176, 177, 182; 450/133, 450/131
See application file for complete search history.

(56) References Cited

U.S. PATENT DOCUMENTS

| | | | | |
|---|---|---|---|---|
| 2,114,004 | A | 4/1938 | Reinthal | 66/195 |
| 3,651,670 | A | 3/1972 | Burleson et al. | 66/177 |
| 3,956,906 | A | 5/1976 | Cassidy, Sr. | 66/42 |
| 3,971,234 | A | 7/1976 | Taylor | 66/200 |
| 3,998,076 | A | 12/1976 | Bianchi et al. | 66/172 E |
| 4,109,492 | A | 8/1978 | Roberts | 66/172 E |
| 4,326,393 | A | 4/1982 | Dunlap | 66/172 E |
| 4,487,040 | A | 12/1984 | Patel et al. | 66/195 |
| 4,998,419 | A | 3/1991 | Moore | 66/25 |
| 5,198,288 | A | 3/1993 | Grunfeld | 428/253 |
| 5,280,652 | A | 1/1994 | Davis et al. | 2/409 |
| 5,687,587 | A | 11/1997 | Michel | 66/196 |
| 5,787,512 | A * | 8/1998 | Knox | 66/171 |
| 5,797,283 | A | 8/1998 | Kaczmarczyk | 66/193 |
| 5,888,914 | A | 3/1999 | Katz | 442/184 |
| 5,987,933 | A | 11/1999 | Metzler | 66/202 |
| 5,991,929 | A * | 11/1999 | Imboden et al. | 66/177 |
| 6,119,491 | A * | 9/2000 | Pinelli | 66/177 |
| 6,192,717 | B1 | 2/2001 | Rabinowicz | 66/177 |
| 6,263,707 | B1 | 7/2001 | Miller et al. | 66/171 |
| 6,272,888 | B1 | 8/2001 | Fujita et al. | 66/172 E |
| 6,287,169 | B1 | 9/2001 | Williams et al. | 450/101 |
| 6,341,506 | B1 | 1/2002 | Myers | 66/189 |
| 6,401,497 | B1 | 6/2002 | Nishiyama et al. | 66/172 E |
| 6,463,765 | B1 | 10/2002 | Blakely | 66/178 R |
| 6,490,890 | B1 | 12/2002 | Irvin et al. | 66/177 |
| 6,502,430 | B1 | 1/2003 | Myers | 66/178 R |
| 6,505,485 | B1 | 1/2003 | Eisberg | 66/178 R |
| 2002/0002846 | A1 | 1/2002 | Bertola | 66/171 |
| 2002/0007507 | A1 | 1/2002 | Duran | 2/406 |
| 2002/0112510 | A1 | 8/2002 | Freedman | 66/202 |
| 2003/0019251 | A1 | 1/2003 | Sciacca | 66/171 |

FOREIGN PATENT DOCUMENTS

| | | |
|---|---|---|
| JP | 2002088516 | 3/2002 |

(Continued)

*Primary Examiner*—Danny Worrell
(74) *Attorney, Agent, or Firm*—Ohlandt, Greeley, Ruggiero & Perle, L.L.P.

(57) ABSTRACT

A circular knit blank and a garment made therefrom. The circular knit blank and garment made therefrom has a first portion being formed from a first yarn having a first elasticity and a second portion integrally knit to the first portion. The second portion has a second yarn with a second elasticity being different than the first elasticity. The second yarn is knitted into a plurality of loops with a desired number of loops of having a tension that is different than the remainder of the plurality of loops so that the second elasticity imparts a selected shape to a body when worn.

23 Claims, 14 Drawing Sheets

FOREIGN PATENT DOCUMENTS

| | | |
|---|---|---|
| JP | 2002115102 | 4/2002 |
| JP | 2002138306 | 5/2002 |
| JP | 2002180305 | 6/2002 |
| JP | 2002235207 | 8/2002 |
| JP | 2002275706 | 9/2002 |

* cited by examiner

CIRCULAR KNIT BLANK AND A GARMENT MADE THEREFROM

BACKGROUND OF THE INVENTION

1. Field of the Invention

The present invention relates to a circular knit blank and a garment made therefrom. More particularly, the present invention relates to a circular knit blank and garment made therefrom that has a first portion having a first yarn and second portion having a second yarn. The second yarn has a second elasticity. The second elasticity imparts a selected shape to a body when worn.

2. Description of the Related Art

A circular knit blank is known in the art. Typically, a circular knitting machine forms a tubular shaped blank from a yarn such as cotton, nylon or spandex, lycra, or a power mesh material. Thereafter, one or more portions of the tubular shaped blank are cut way from the tubular shaped blank to form a completed shirt or knit panty. However, consumers desire a garment that is comfortable and has an improved and flattering fit.

Control wear is known in the art. Attempts have been made in the past to increase comfort and fit associated with garments by adding in elastic regions to the garments at, for example, a breast region.

Circular knit control wear is also known in the art. Attempts were made to add in elastic yarns to the circular knit tubular blank to form elastic regions. This allows for increased comfort and shapeability. By adding in elastic yarns to the circular knit tubular blank, there are a number of drawbacks. By varying a tension of the elastic yarn as the elastic yarn is fed into the circular knit tubular blank attempts were made to control the elasticity of the garment. However, this method only varies the tension in a course-wise direction of the garment.

Others attempts in the art were made by adding in additional loops of elastic yarn at desired regions of the garment. However, these additional loops only vary the tension in a wale-wise direction of the fabric. Also, the additional loops of elastic yarn being added to the circular knit tubular blank leave unsightly and uncomfortable.

Thus, there is a need for a more comfortable circular knit garment formed from a tubular blank that imparts a selected shape to a body when worn.

SUMMARY OF THE INVENTION

These and other objects and advantages of the present invention are achieved by the blank and garment of the present invention.

The blank, and the garment made therefrom, have a first portion formed from a first yarn with a first elasticity and a second portion having a second yarn. The second yarn has a second elasticity that is different from the elasticity of the first yarn. The first and second portions are integrally knit together. The second yarn is knitted into a plurality of loops. One or more of the loops of the plurality of loops of the second yarn have a tension that is different than a remainder of the loops so that the second elasticity imparts a selected desired shape to a body when worn.

In each desired shaped zone, the second yarn is used. Thus, depending on the desired shaping in that zone, one or more loops of the plurality of loops of the second yarn may have a tension different than the remaining loops of the plurality of loops or each loop may have a different tension from every other loop or all but one or two loops may have the same tension.

In a second embodiment, the blank and the garment made therefrom has a rib section between the first and second fabric portions. The plurality of loops has free ends knit in the rib section. The rib section hides the free ends.

According to another embodiment of the present invention, the second fabric portion has a plurality of loops. A desired number of the plurality of loops has a tension that is different than a remainder of the blank and a size that is different from the remainder of the blank. The blank also has a rib section between the first and second fabric portions. The rib section includes an end portion of the plurality of loops.

The above and other objects, advantages and benefits of the present invention will be understood by reference to the detailed description provided below and the accompanying drawings.

DETAILED DESCRIPTION OF THE INVENTION

Figure 1:
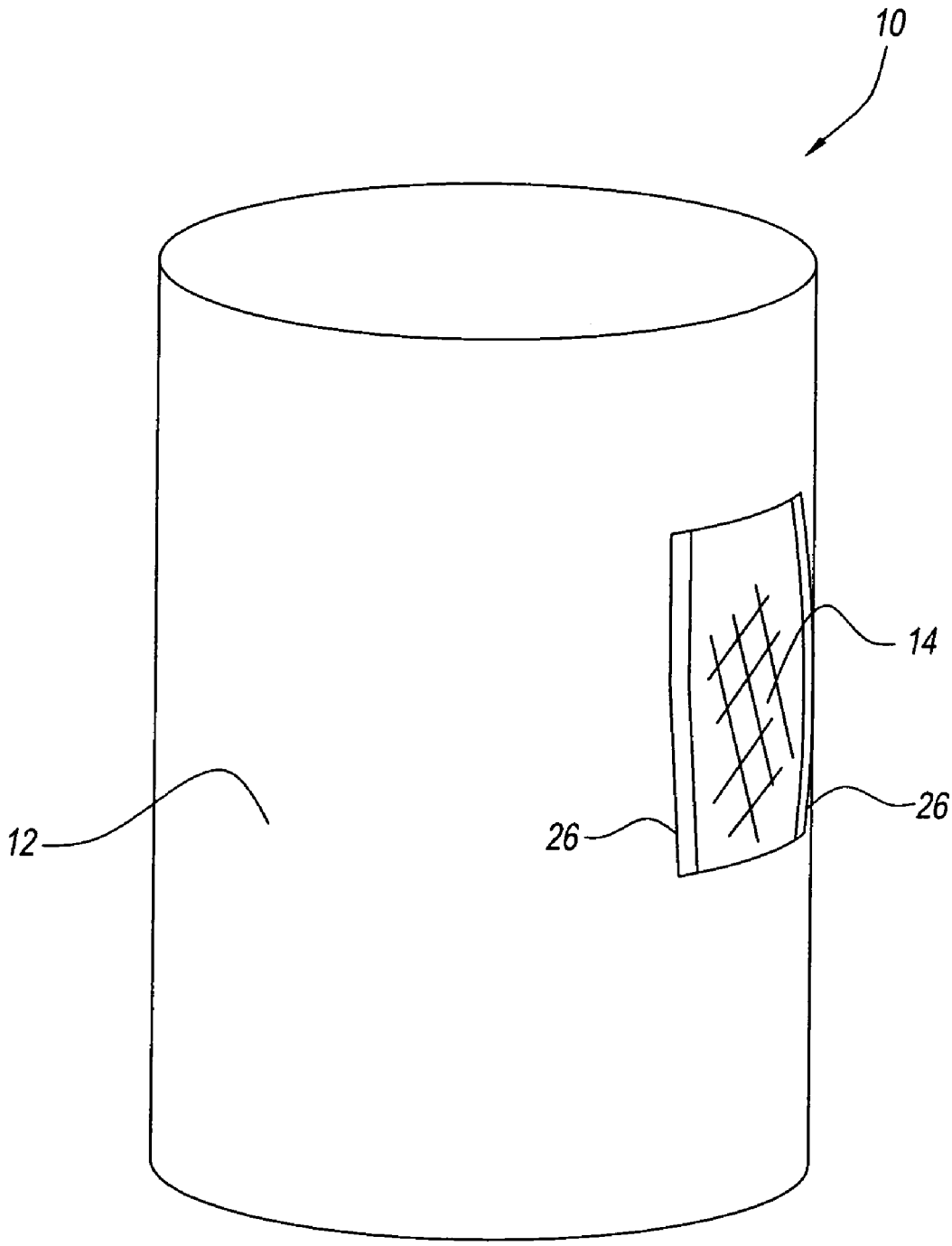
FIG. 1 is a front view of a blank in accordance with a preferred embodiment of the present invention.
Figure 2:
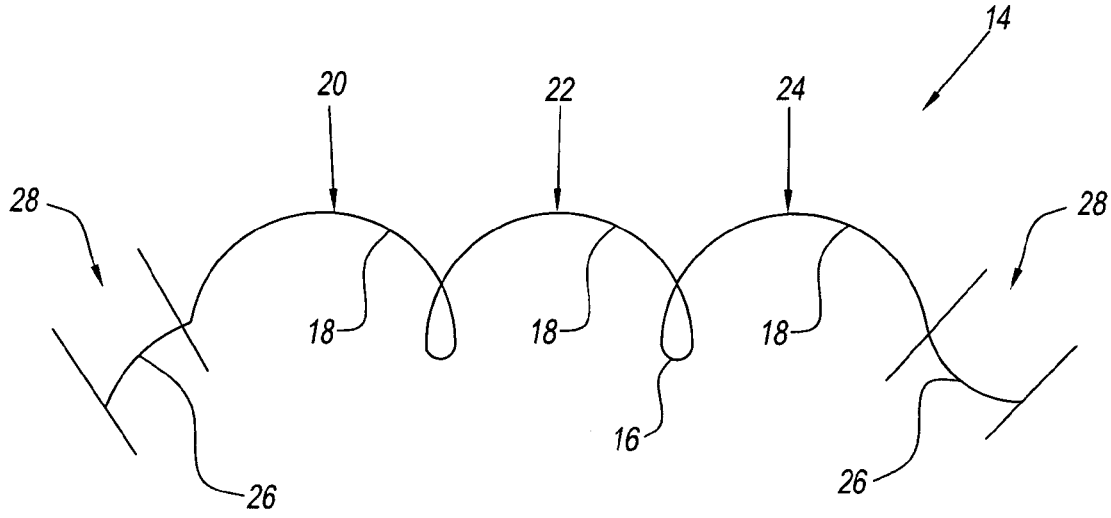
FIG. 2 is a front view of a fabric having a number of loops forming the blank of FIG. 1, a desired number of the loops having a different tension.

Referring to the figures and, in particular, to FIGS. 1 and 2, there is provided a circular knit blank according to the present invention generally represented by reference numeral 10. The circular knit blank 10 preferably is formed from a first portion 12 integrally knit with a second portion 14.

The first portion 12 is knit by a first yarn (not shown). The first yarn is preferably a cotton, a nylon including a textured nylon, a spandex such as Lycra, a polyester, or any combinations thereof. The second portion 14 is formed from a second yarn 16. The second yarn 16 is, preferably, an elastic yarn knit in a number of loops 18 as shown in FIG. 2. For example, second yarn 16 can be a polyurethane, a nylon, a spandex such as Lycra, or another elastic. The second elasticity is preferably greater than the first elasticity.

Blank 10 is knit such that a desired number of loops 18 each have a desired tension and a desired size. In exemplary embodiment of the present invention, loops 18 have a similar tension and similar size.

In another embodiment loops 18 of the second yarn 16 have a tension that is different than a remainder of the loops so that the second elasticity imparts a selected desired shape to a body when worn, for example in a thigh region.

In each desired shaped zone, the second yarn 16 is used. Thus, depending on the desired shaping in that zone, one or more loops 18 of the second yarn 16 may have a tension different than the remaining loops or each loop may have a different tension from every other loop or all but one or two loops may have the same tension.

Preferably, loops 18 have a tension that is different from the tension in each other loop 18. For example, loops 18 can have a first tension 20, a second tension 22, and a third tension 24. Each of the first, second, and third tensions 20, 22, 24 may each have a first, a second, and a third value. The first, second, and third value can be same or different from the remainder of the values.

Blank 10 is formed on a typical circular knit machine (not shown) having a stitch cam and a yarn feeder. The machine can control the stitch cam that is configured to selectively vary size of the loops 18, while the yarn feeder is configured to selectively vary the tension in the loops.

It has been found that blank 10 having a first portion with a first tension and a second portion 14 with two or more loops 18 each having a different tension provides increased comfort and shaping than previously possible.

A second significant feature of the present invention deals with the incorporation of loops 18 into blank 10 can leave free ends 26 that are unsightly and uncomfortable. In prior blanks, free ends 26 will protrude slightly from the blank and are unsightly relative to the smooth fabric course. In prior blanks, these free ends 26 have required trimming by a manual cutting operation. In order to remove this step of the manual trimming operation to trim the free ends 26, the blank 10 knits the free ends 26 into the blank 10. One skilled in the art should appreciate that the free ends 26 knit into the blank 10 are no longer unsightly and are substantially hidden in the smooth fabric course.

Figure 3:
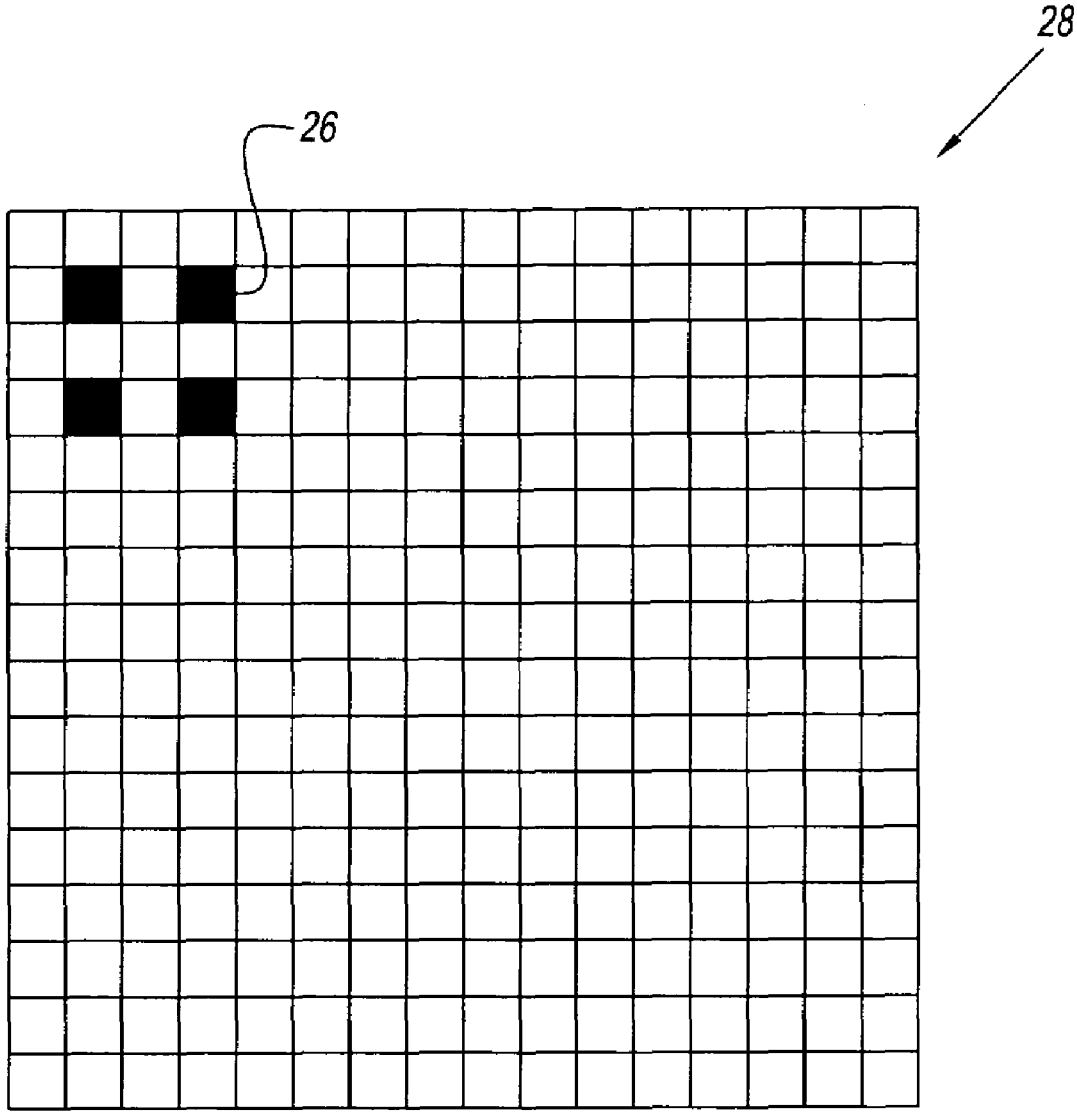
FIG. 3 is a stitch diagram of a rib section of FIG. 1.

Preferably, the free ends 26 are knit into a feature of the blank 10. One such feature that the free ends 26 are knit into is shown by a stitch diagram shown in FIG. 3. The stitch diagram shows the free ends 26 as a stitch by the dark colored rectangle and the white colored rectangle as a misstitch. Advantageously, blank 10 has a rib section 28, illustrated in FIG. 3, that incorporates free ends 26 therein and, thus, eliminates this costly manual cutting operation.

The rib section 28 is disposed preferably at a transition between the first portion 12 and the second portion 14. However, one skilled in the art should appreciate that the rib section 28 may be placed anywhere on the blank 10 where the free ends 26 are present. Since free ends 26 are hidden in rib section 28, blank 10 provides for the manufacture of more attractive and comfortable garments than previously possible without expensive and timely manual cutting operations. Free ends 26 are knit into rib section 28 by a float stitching operation. Here, free ends 26 may be hidden in a partially positive float or a clear float stitching operation.

Advantageously, it has been found that rib section 28 not only hides free ends 26, but also aids in maintaining the tension of the second yarn 16 in second portion 14. Thus, rib section 28 mitigates instances of free ends 26 pulling into second portion 14 during use and loosening the elasticity of the second portion.

Figure 4:
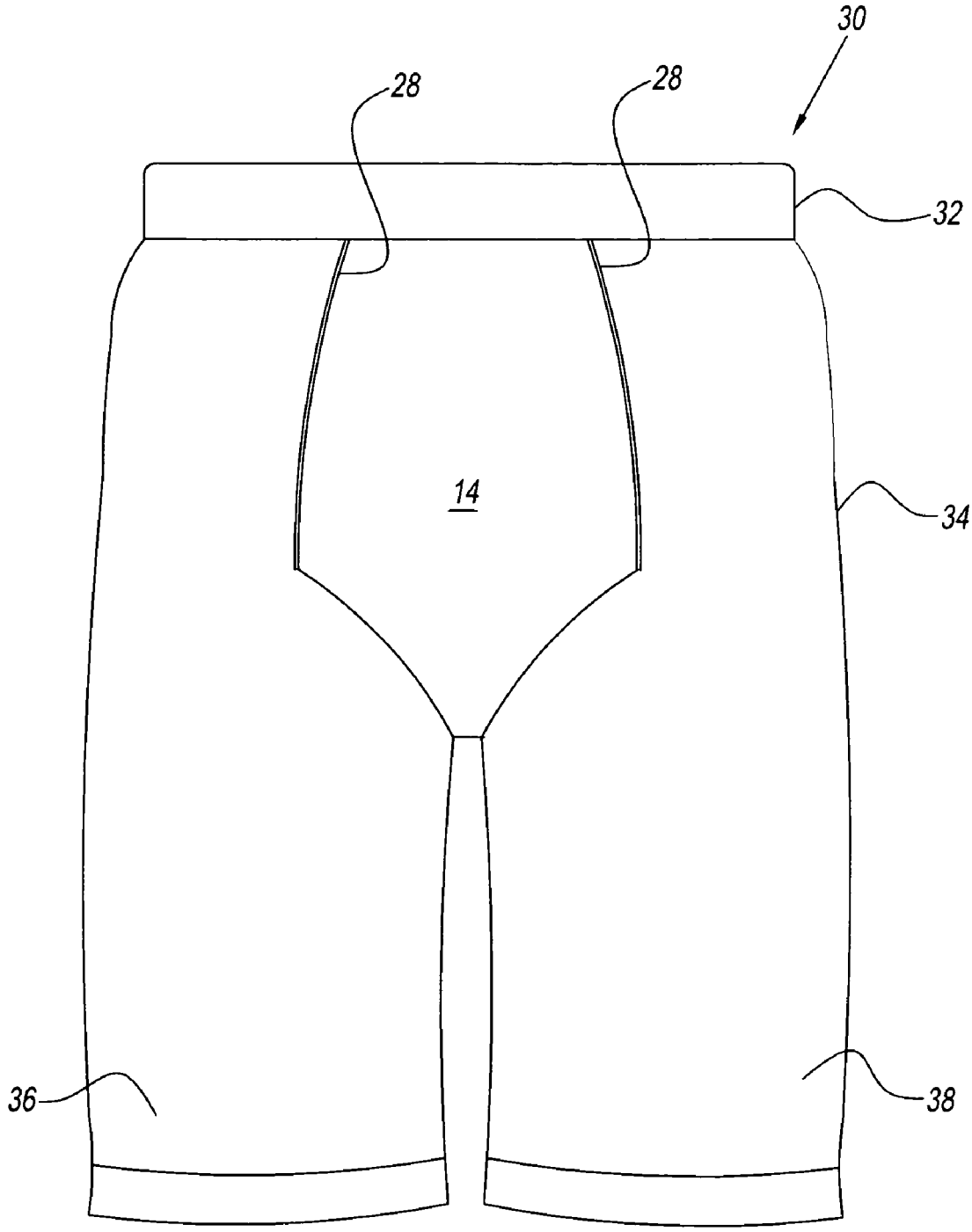
FIG. 4 is a front view of a garment of the present invention.

The blank 10 can be used to form a garment 30 such as that shown in FIG. 4. For purposes of clarity, garment 30 formed from blank 10 is illustrated in FIG. 4 as a circular knit panty. However, one skilled in the art should appreciate that garment 10 can be any circular knit garment, such as but not limited to, a brassiere, a panty, a pair of shorts, a pair of socks, a hat, a shirt, underwear, a torso-encircling garment, a waist encircling garment, or any other circular knit garment.

In the panty shown in FIG. 4, garment 30 has a waist-encircling portion 32, a stomach portion 34, a first leg portion 36, and a second leg portion 38. In this manner, a user may wear the garment 30 in the conventional manner and have the waist-encircling portion 32 secure the garment to the user's torso.

It has been observed that a preferred consumer preference is to have an article of clothing that allows the wearer to have slimmer appearing stomach, without the discomfort typically associated with elastic regions formed from additional yarns. Thus, the garment 30 also includes second portion 14 defined in the stomach portion 34.

It should be recognized that garment 30 is described herein having second portion 14 disposed in stomach portion 34. Of course, it is contemplated by the present invention for garment 30 to have second portion 14 disposed at any selected area or areas of the garment, such as, first and second leg portions 36, 38.

Figure 5:
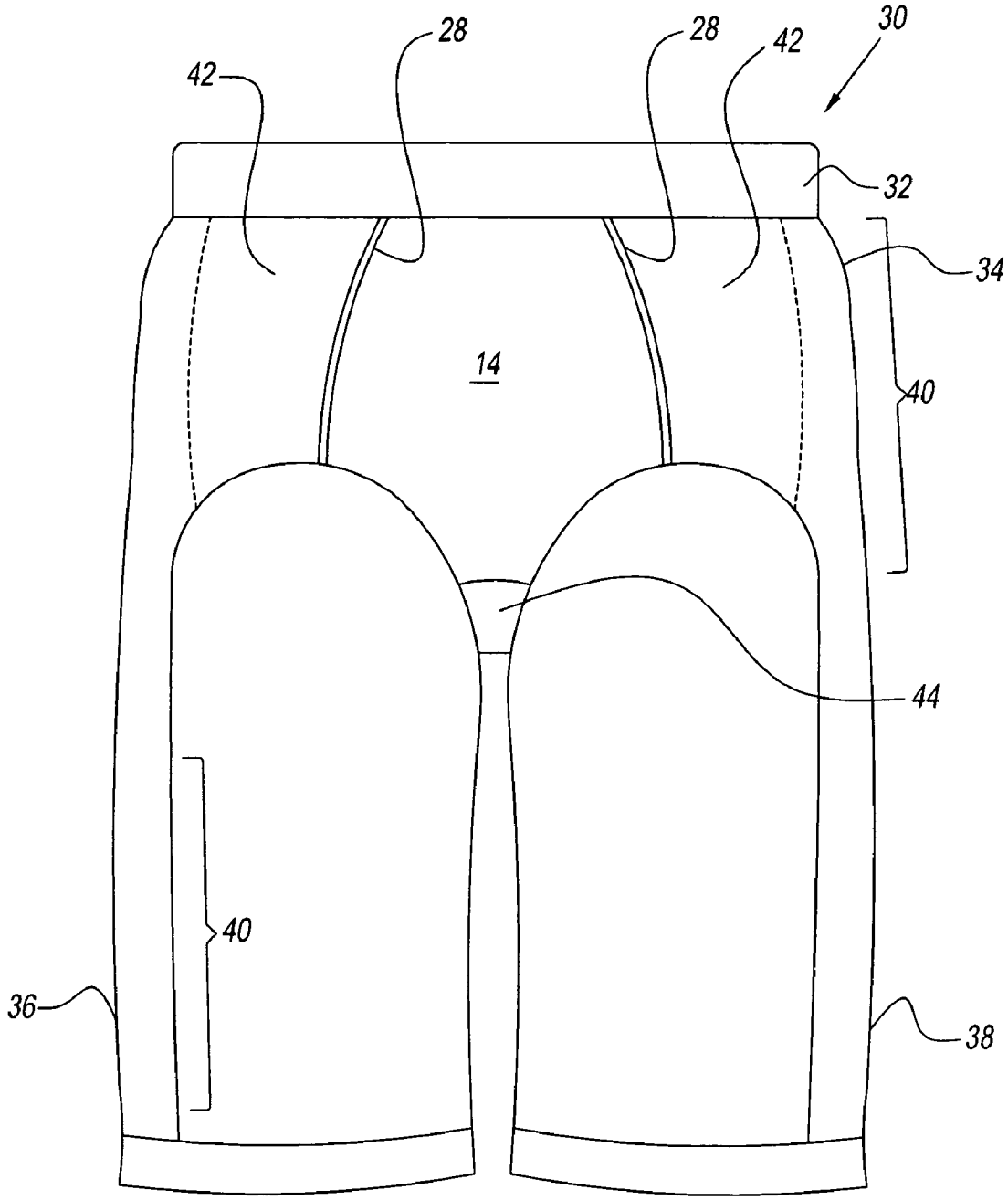
FIG. 5 is a view of an alternate embodiment of the garment of FIG. 4.

In addition to second portion 14, blank 10, and thus garment 30, can include other control or shaping regions. For example, garment 30 is illustrated in FIG. 5 has a first zone 40. The first zone 40 is preferably disposed in a thigh location of the garment 30.

Figure 7:
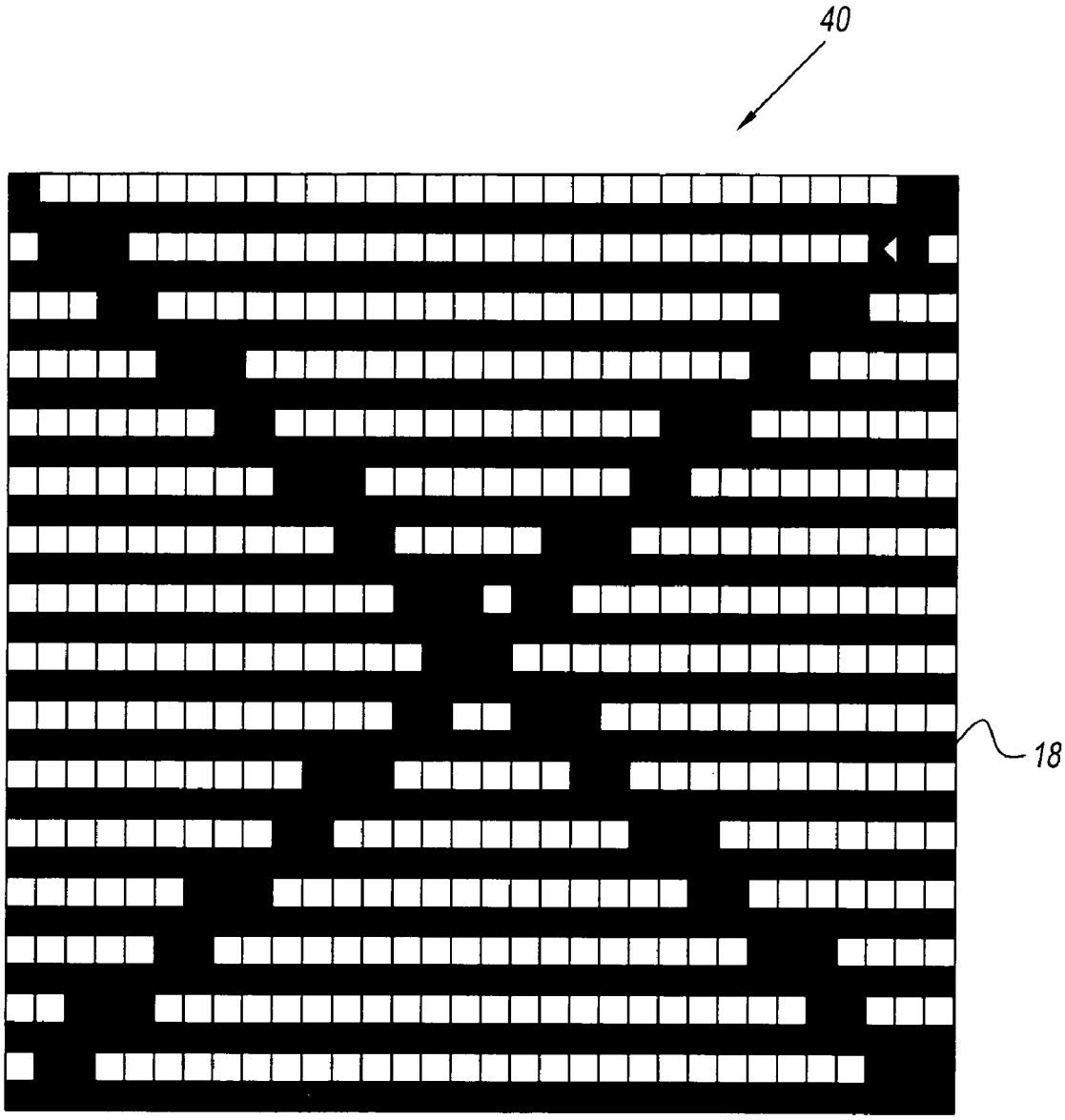
FIG. 7 is a stitch diagram of a first zone of FIG. 5.

Referring to FIG. 7, there is shown a stitch diagram of a first embodiment of the first zone 40. As can be understood from FIG. 7, the stitch diagram shows the loops 18 as a stitch by the dark colored rectangle and the white colored rectangle as a misstitch. As can be understood, the stitches and misstitches form an overall general crisscross pattern as can be recognized in FIG. 7.

Preferably, this stitching arrangement provides a two component tension in preferably a course-wise direction of the garment 30 and a wale-wise direction of the garment. This allows the loops 18 in the first zone 40 to have a tension that is different than a remainder of the garment 30. The first zone 40 imparts a shape to a body, when the garment is worn relative to the remainder of the garment 30. In one example, the shape imparted to the body is in the thigh region.

In a preferred embodiment of the present invention being shown in FIG. 5, the first zone 40 is located on the first leg 36 and the second leg 38 of the garment 30. The first zone 40 allows the user to have the appearance of slimmer thighs while the remainder of the garment 30 is relatively looser and comfortable than the first zone.

Figure 8:
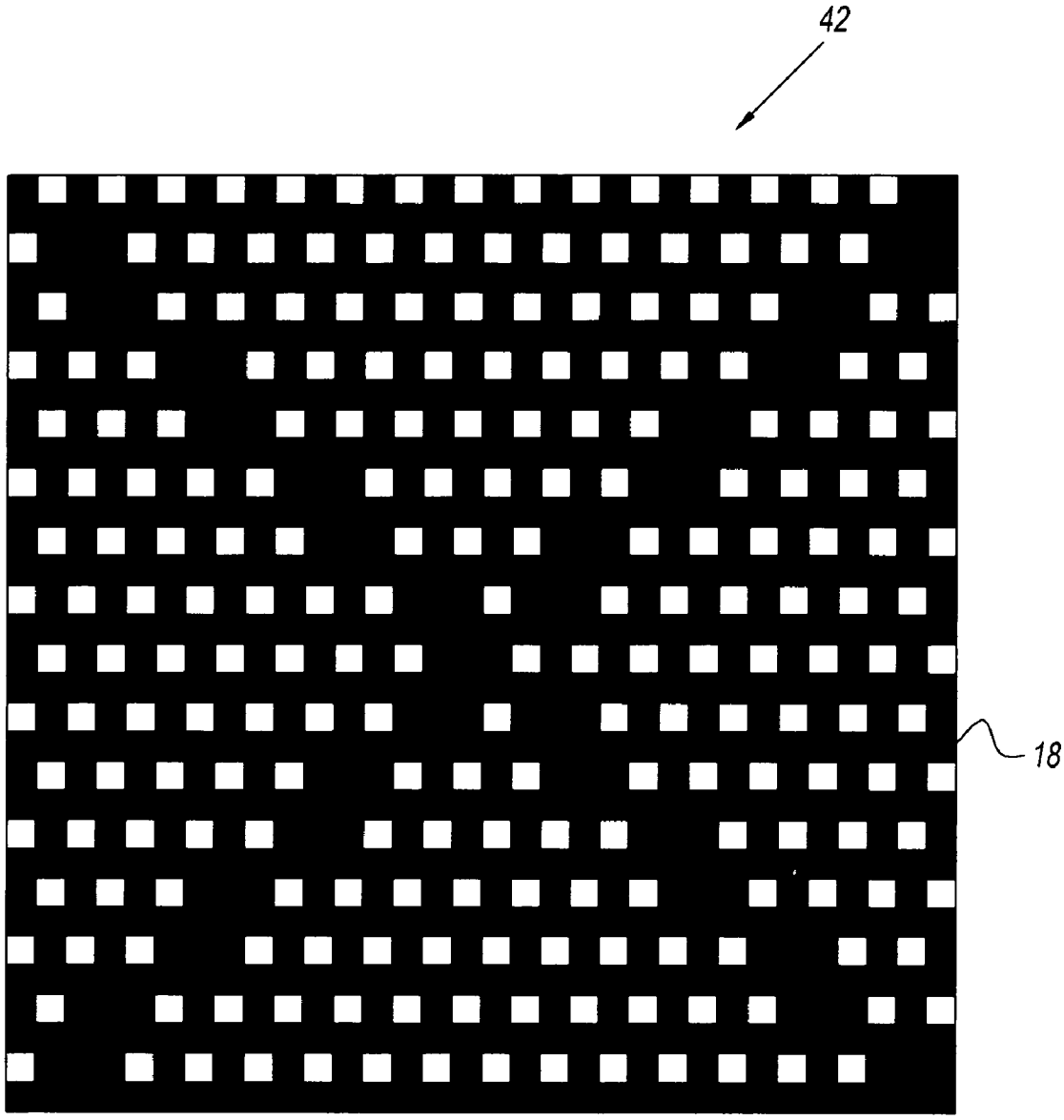
FIG. 8 is a stitch diagram of a second zone of FIG. 5.

Referring to FIG. 8, there is shown another stitch diagram of a second embodiment of a second zone being generally designated as reference numeral 42. The second zone 42 preferably forms an overall general crisscross pattern. As can be understood from FIG. 8, the second zone 42 has a greater number of mis-stitches (white color) relative to stitches (dark color) and accordingly a relative less resistance to stretching than the first zone 40. Preferably, second zone 42 is disposed on a portion of the stomach portion 34 as shown in FIG. 5.

Figure 9:
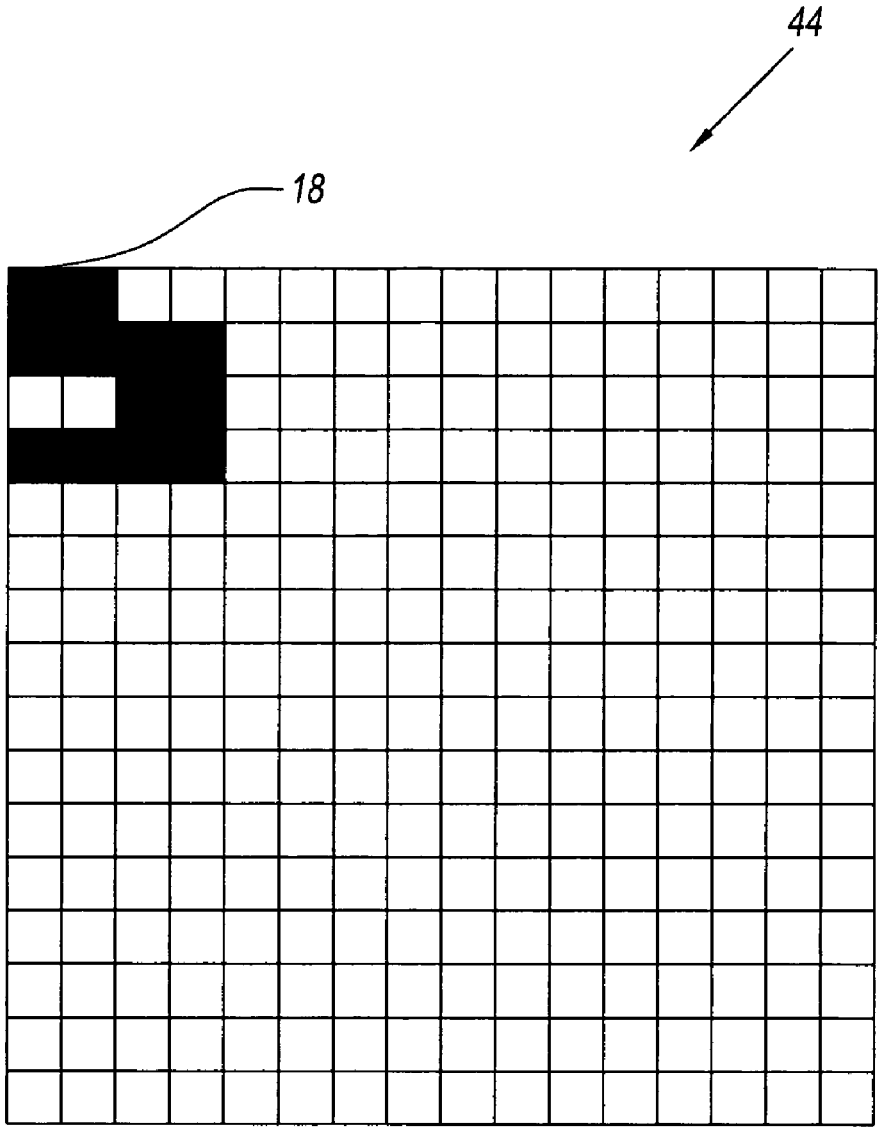
FIG. 9 is a stitch diagram of a third zone of FIG. 5.

Referring to FIG. 9, there is shown another stitch diagram of a third zone being generally represented as reference numeral 44. The stitch diagram shows the loops 18 as a stitch by the dark colored rectangle and the white colored rectangle as a misstitch. Preferably, the third zone 44 forms an absorbent terry cloth that can be disposed in a crotch portion of the garment 30.

Figure 10:
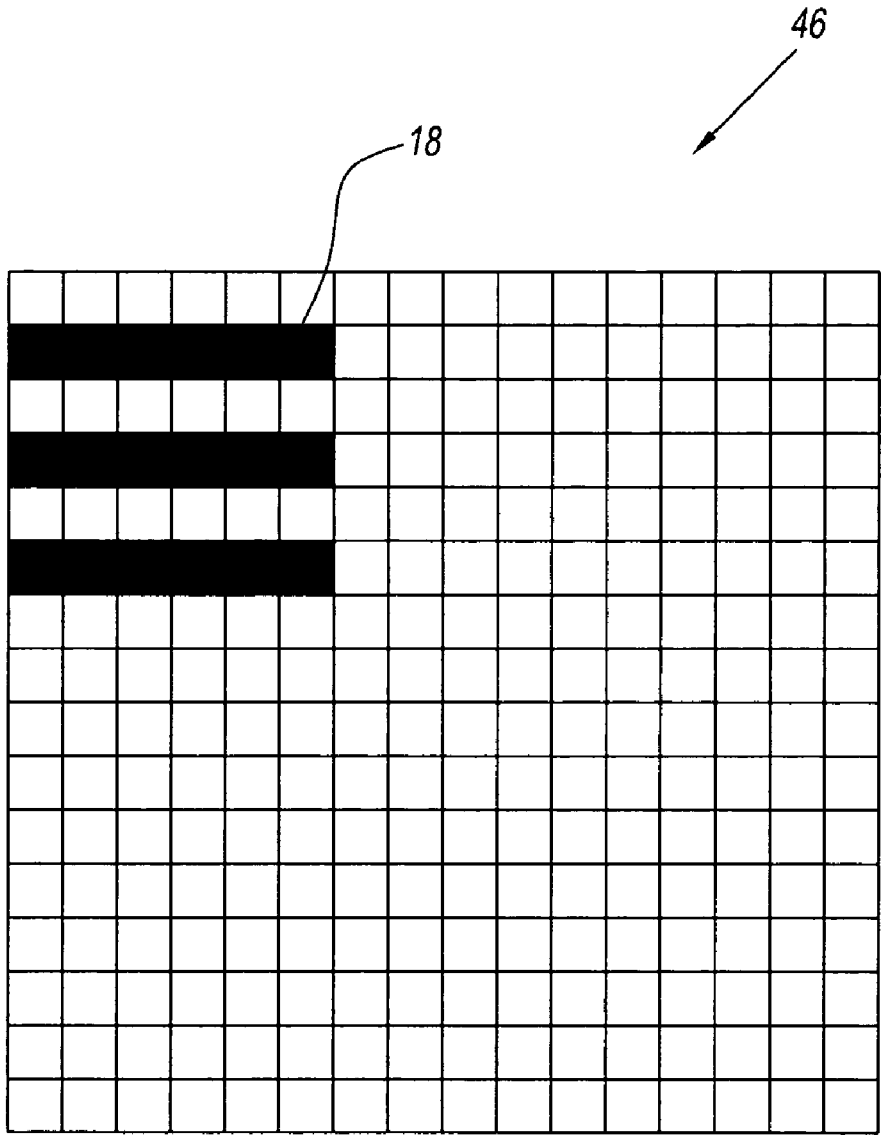
FIG. 10 is a stitch diagram of a fourth zone of FIG. 5.

Referring to FIG. 10, there is shown another stitch diagram of a fourth zone being generally designated as reference numeral 46. As mentioned, the stitch diagram shows the loops 18 as a stitch by the dark colored rectangle and the white colored rectangle as a misstitch. Preferably, fourth zone 46 forms a portion of the first leg 36 and the second leg 38 of the garment 30 being adjacent to the first zone 40 as shown in FIG. 6.

Figure 11:
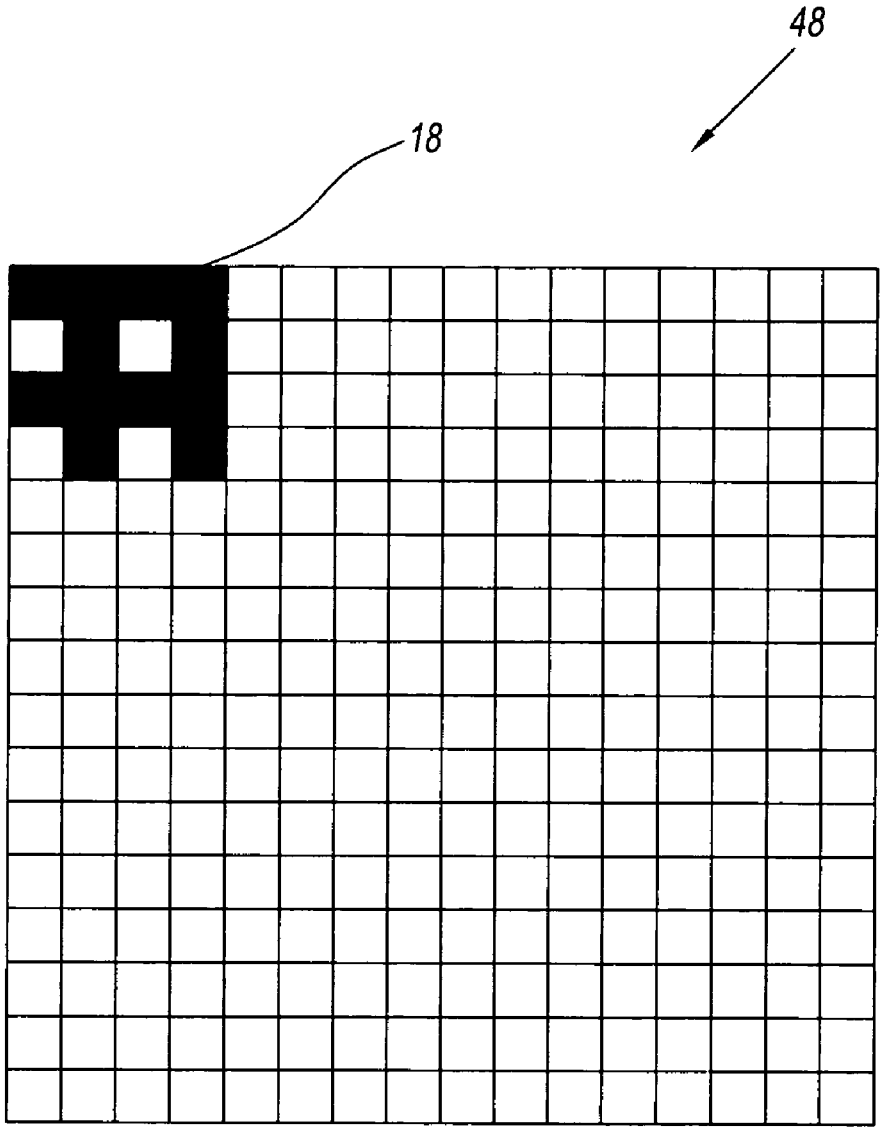
FIG. 11 is a stitch diagram of a fifth zone of FIG. 5.

Referring to FIG. 11, there is shown still another stitch diagram of a fifth zone of the garment being generally referenced as reference numeral 48. The stitch diagram shows the loops 18 as a stitch by the dark colored rectangle and the white colored rectangle as a misstitch. Fifth zone 48 preferably forms a second rib section disposed between the stomach portion 34 and second zone 42.

Figure 12:
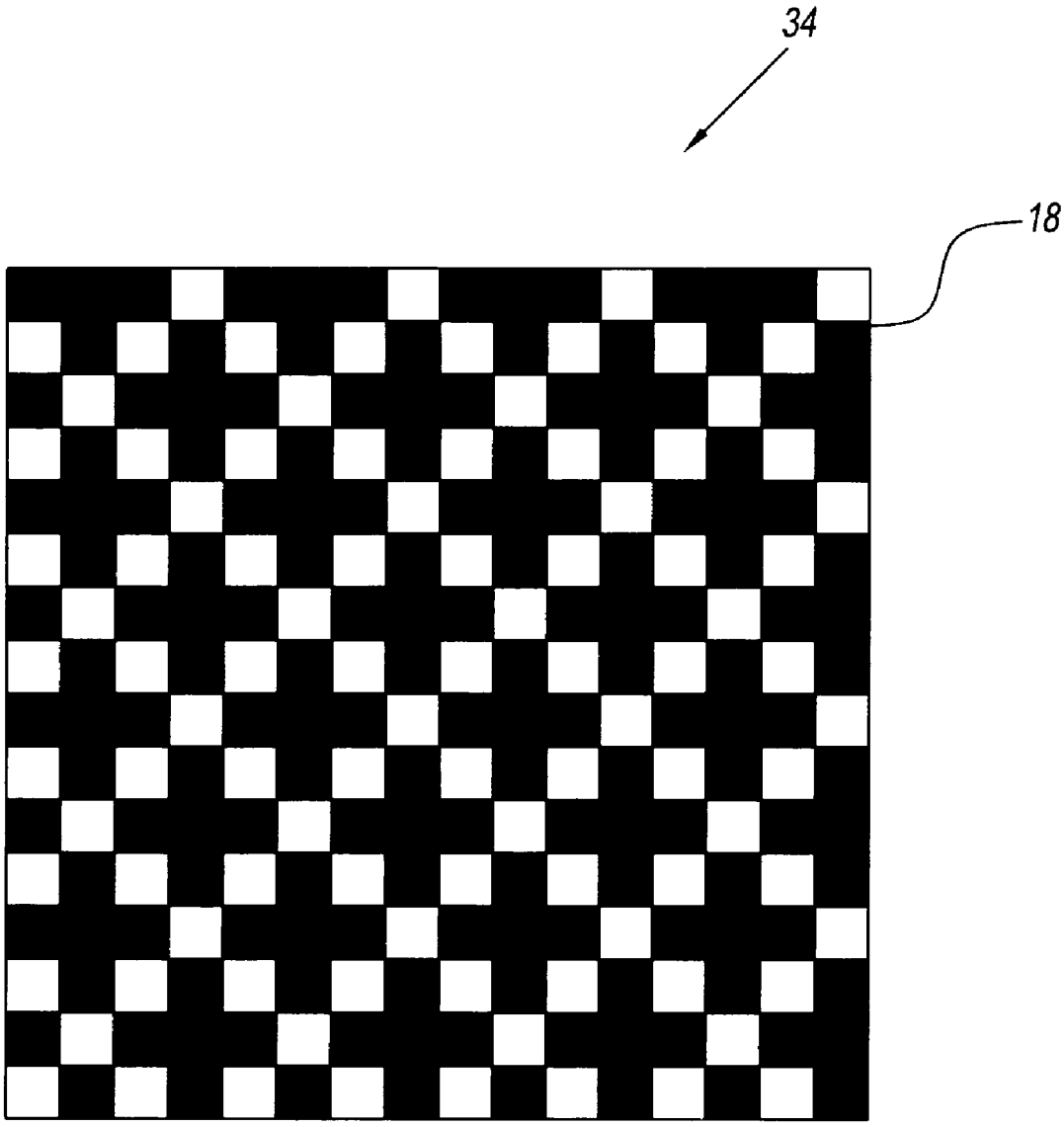
FIG. 12 is a stitch diagram of a stomach portion of FIG. 3.

Referring to FIG. 12, there is shown another stitch diagram of the stomach portion 34. In an alternative embodiment, the stomach portion 34 is stitched to be looser fitting. The stitch diagram shows the loops 18 as a stitch by the dark colored rectangle and the white colored rectangle as a misstitch. This allows a user to have a comfortable looser fitting in the stomach portion 34 of the garment 30.

Figure 6:
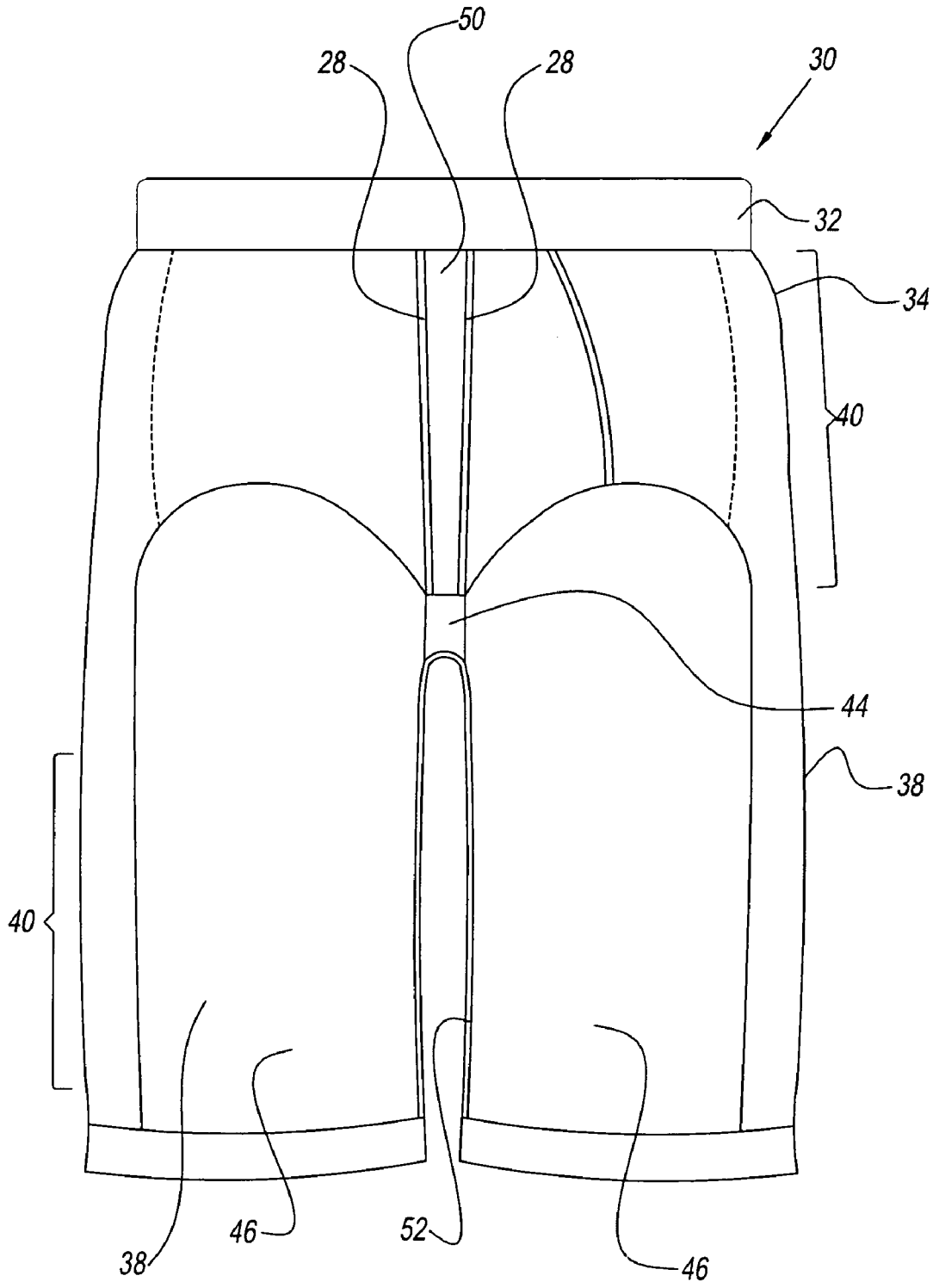
FIG. 6 is a rear view of the garment of FIG. 5.
Figure 13:
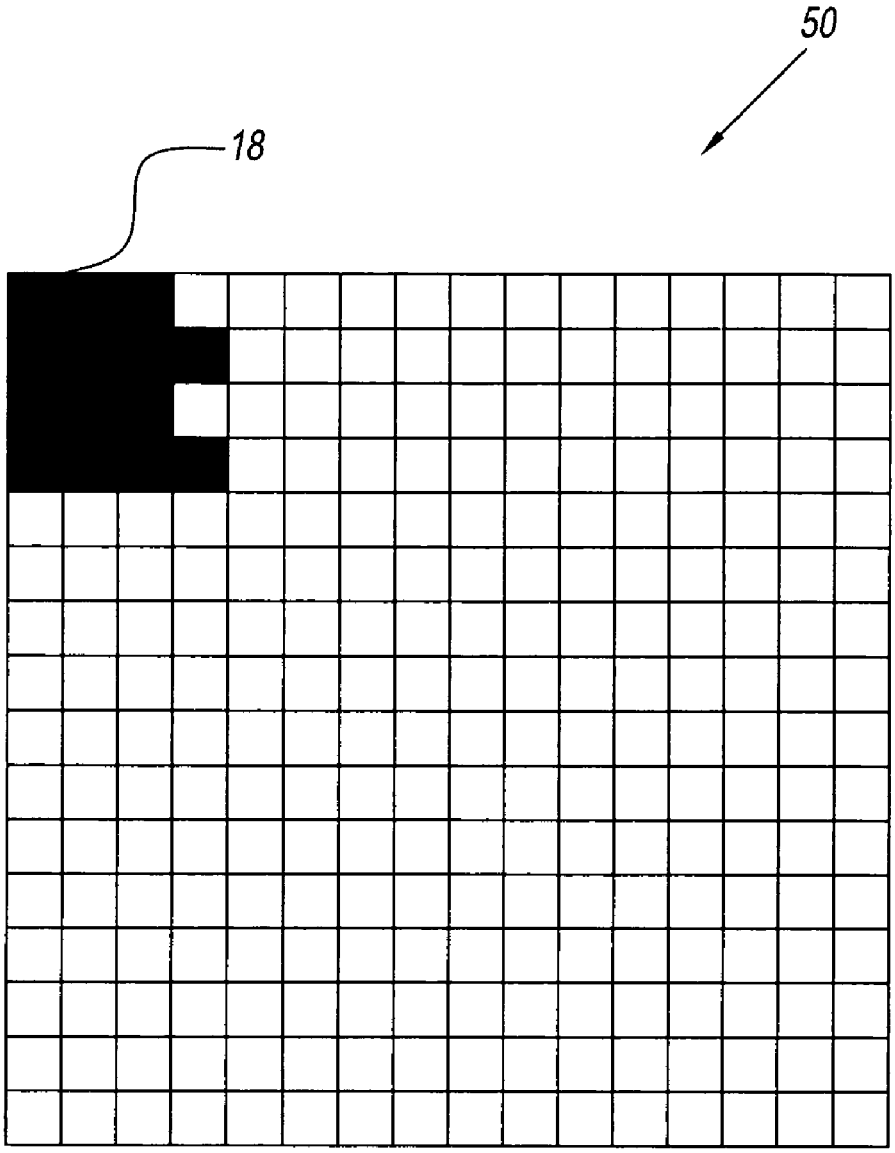
FIG. 13 is a stitch diagram of a sixth zone of FIG. 6.

Referring to FIG. 6, there is shown a rear view of the garment 30. Disposed in the rear of the garment 30 is a sixth zone 50 for added comfort. The sixth zone 50 is disposed in the rear of the garment 30. The sixth zone 50 may be disposed between a pair of rib sections 28. A stitch diagram of the sixth zone 50 is shown in FIG. 13. The stitch diagram shows the loops 18 as a stitch by the dark colored rectangle and the white colored rectangle as a misstitch.

The sixth zone 50 preferably extends from the crotch portion of the garment 30 longitudinally to the waist encircling portion. The sixth zone 50 also extends laterally between the buttocks of the garment 30 to provide added comfort to the garment 30.

Figure 14:
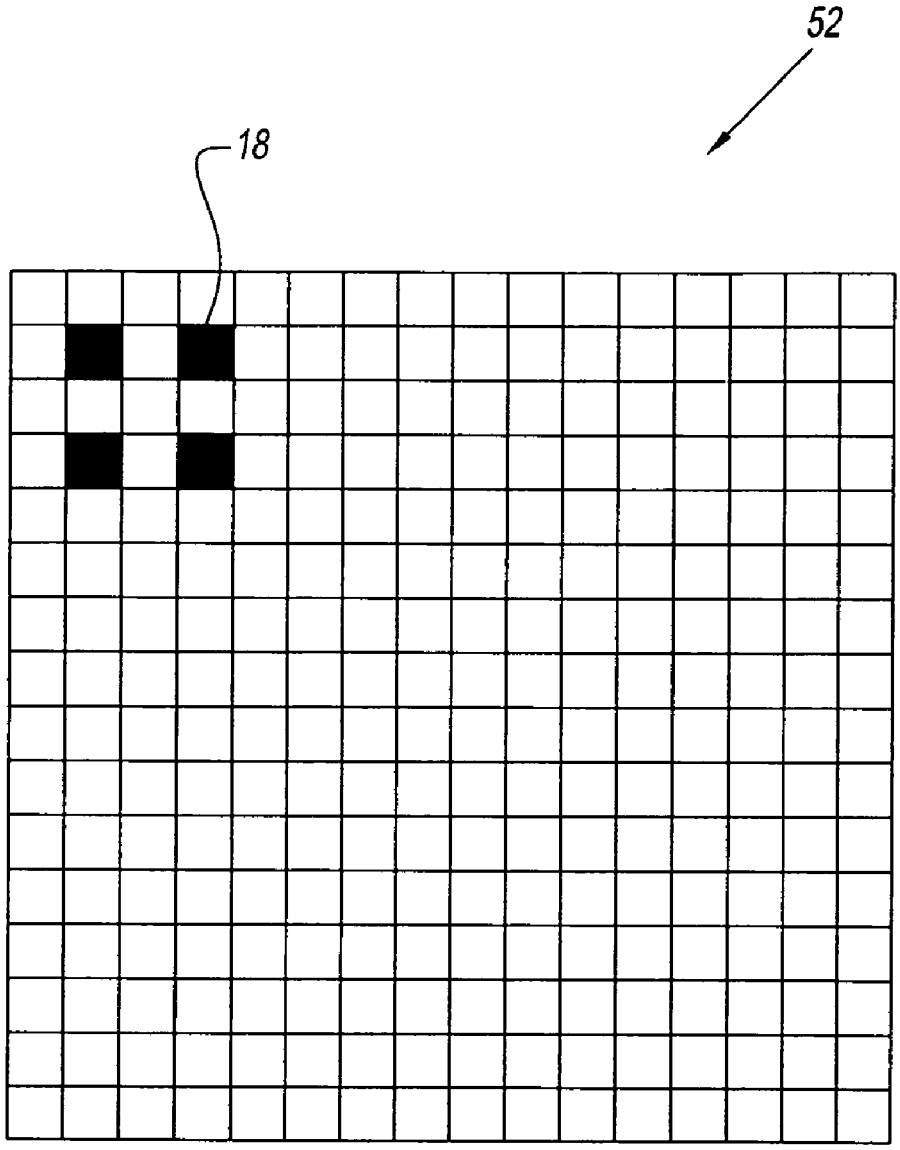
FIG. 14 is a stitch diagram of a seventh zone of FIG. 6.

Referring to FIG. 14, there is shown another stitch diagram of a seventh zone 52. The stitch diagram shows the loops 18 as a stitch by the dark colored rectangle and the white colored rectangle as a misstitch. In an alternative embodiment, the seventh zone 52 is disposed in a location extending longitudinally from the crotch portion to the first and the second leg portion 36, 38. This allows a user to have a comfortable fitting in the crotch portion and leg portions 36, 38 of the garment 30.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A blank comprising:

a first portion being formed from a first yarn having a first elasticity;

a second portion being integrally knit to said first portion, said second portion having a second yarn, said second yarn having a second elasticity different than the first elasticity, said second yarn being knitted into a plurality of loops, a desired number of loops of said plurality of loops having a tension that is different than the remainder of said plurality of loops so that said second elasticity imparts a selected shape to a body when worn.

2. The blank of claim 1, wherein each loop in said plurality of loops has a size.

3. The blank of claim 1, wherein said size of said desired number of loops in said plurality of loops is different from the remainder of said plurality of loops.

4. The blank of claim 1, wherein said blank forms a garment selected from the group consisting of a brassiere, a panty, a pair of shorts, a pair of socks, a hat, a shirt, underwear, a torso-encircling garment, and a waist encircling garment.

5. The blank of claim 1, wherein said blank forms a panty, said second portion being disposed in a position selected from the group consisting of a crotch portion, a stomach portion, a side portion, a band portion, a leg portion, a remainder of said garment, a buttock portion, and any combinations thereof.

6. The blank of claim 1, wherein said first yarn is formed of a material selected from the group consisting of cotton, nylon, spandex, polyester, and any combinations thereof.

7. The blank of claim 1, wherein said second yarn is formed of a material selected from the group consisting of polyurethane, nylon, spandex, elastic yarn, and any combinations thereof.

8. A blank comprising:

a first fabric portion being knit with a first yarn having a first elasticity;

a second fabric portion being integrally knit to said first fabric portion with a plurality of loops from a second yarn, said second yarn having a second elasticity different than said first elasticity; and a rib section being positioned between said first and second fabric portions, at least two of said plurality of loops having free ends being knit in said rib section so that said free ends are hidden by said rib section.

9. The blank of claim 8, wherein said second fabric portion imparts a selected shape to a body when worn.

10. The blank of claim 8, wherein said free ends are knit into said rib section by a float stitching operation.

11. The blank of claim 8, wherein said rib section mitigates said free ends from pulling into said second fabric portion.

12. The blank of claim 8, wherein said rib section maintains a tension of said plurality of loops.

13. The blank of claim 8, wherein the blank is a knit panty having a stomach portion and a side portion, and wherein said rib section is defined at a transition between said stomach portion and said side portion.

14. The blank of claim 8, wherein a desired number of loops of said plurality of loops has a tension, said tension being different than a remainder of the blank.

15. The blank of claim 14, wherein said desired number of loops in said plurality of loops has a size that is different from one another.

16. A blank comprising:

a first fabric portion being formed from a first yarn having a first elasticity;

a second fabric portion being integrally knit to said first fabric portion, said second fabric portion being formed from a second yarn having a second elasticity, said second elasticity being different than said first elasticity, said second fabric portion having a plurality of loops, a desired number of said plurality of loops having a size that is different than the remainder of said plurality of loops and having a tension that is different than the remainder of said plurality of loops; and a rib section being positioned between said first and second fabric portions, said rib section including an end portion of said plurality of loops.

17. The blank of claim 16, wherein said end portion is at least two free ends of said plurality of loops.

18. A circular knit panty comprising:

a first fabric portion being formed from a first yarn having a first elasticity, said first fabric portion forming a waist-encircling portion, a stomach portion, a first leg portion, a second leg portion, and a crotch portion;

a second fabric portion being integrally knit to said first leg portion and said second leg portion, said second fabric portion being formed from a second yarn having a second elasticity, said second elasticity being different than said first elasticity, said second fabric portion having a plurality of loops, a desired number of said plurality of loops having a size that is different than the remainder of said plurality of loops and having a tension that is different than the remainder of said plurality of loops, wherein said second elasticity imparts a selected shape to a first and a second thigh when worn;

a first rib section being positioned between said first fabric portion and said first leg portion; and a second rib section being positioned between said first fabric portion and said second leg portion, said first and said rib sections each including an end portion of said plurality of loops.

19. The circular knit panty of claim 18, wherein said first yarn is formed of a material being selected from the group consisting of cotton, nylon, spandex, polyester, and any combinations thereof.

20. The circular knit panty of claim 19, wherein said second yarn is formed of a material being selected from the group consisting of polyurethane, nylon, spandex, and any combinations thereof.

21. The circular knit panty of claim 18, wherein said second fabric portion is integrally knit to said crotch portion.

22. The circular knit panty of claim 18, wherein said second fabric portion is integrally knit to said stomach portion.

23. The circular knit panty of claim 18, wherein said end portion is at least two free ends of said plurality of loops.

* * * * *